US008529231B2

(12) United States Patent
Park

(10) Patent No.: US 8,529,231 B2
(45) Date of Patent: Sep. 10, 2013

(54) APPARATUS FOR CLEANING ROTATION BODY AND VACUUM PUMP HAVING THE SAME

(75) Inventor: Tea-Jin Park, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 739 days.

(21) Appl. No.: 12/701,956

(22) Filed: Feb. 8, 2010

(65) Prior Publication Data

US 2010/0202912 A1 Aug. 12, 2010

(30) Foreign Application Priority Data

Feb. 9, 2009 (KR) ..... 10-2009-0010346

(51) Int. Cl.
*F01C 1/30* (2006.01)
*F03C 2/00* (2006.01)

(52) U.S. Cl.
USPC ..... 418/9; 418/5; 418/7; 418/206.1; 418/206.8

(58) Field of Classification Search
USPC ..... 418/181, 9, 5; 15/3; 417/321
See application file for complete search history.

(56) References Cited

U.S. PATENT DOCUMENTS

| | | | | |
|---|---|---|---|---|
| 5,049,050 | A * | 9/1991 | Berges et al. | 418/97 |
| 5,173,041 | A * | 12/1992 | Niimura et al. | 418/9 |
| 5,356,275 | A * | 10/1994 | Brenner et al. | 418/9 |
| 6,123,526 | A * | 9/2000 | Chen et al. | 418/9 |
| 6,471,497 | B2 * | 10/2002 | Suzuki et al. | 418/9 |
| 7,108,492 | B2 * | 9/2006 | Yamamoto et al. | 418/5 |
| 7,214,041 | B2 * | 5/2007 | Birch et al. | 418/9 |
| 7,748,970 | B2 | 7/2010 | Park | |
| 8,083,507 | B2 * | 12/2011 | Park et al. | 418/9 |
| 2005/0069440 | A1 * | 3/2005 | Naito | 418/9 |
| 2007/0140881 | A1 * | 6/2007 | Matsumoto et al. | 418/9 |
| 2008/0118383 | A1 | 5/2008 | Park | |
| 2008/0226485 | A1 | 9/2008 | Park et al. | |
| 2010/0202912 | A1 | 8/2010 | Park | |

FOREIGN PATENT DOCUMENTS

| | | |
|---|---|---|
| JP | 09-027458 | 1/1997 |
| JP | 2001-000025 | 1/2001 |
| JP | 2003-297762 | 10/2003 |
| JP | 2005-171766 | 6/2005 |
| JP | 2006-525467 | 11/2006 |
| KR | 1020050013016 | 2/2005 |
| KR | 1020060009907 | 2/2006 |
| KR | 1020060075558 | 4/2006 |
| KR | 1020060084280 | 7/2006 |
| KR | 10-0773358 | 10/2007 |

OTHER PUBLICATIONS

English Abstract for Publication No. 09-027458, Jan. 28, 1997.
English Abstract for Publication No. 2001-000025, Jan. 9, 2001.

(Continued)

*Primary Examiner* — Mary A Davis
*Assistant Examiner* — Deming Wan
(74) *Attorney, Agent, or Firm* — F. Chau & Associates, LLC

(57) ABSTRACT

An apparatus includes a rotation body having one or more rotary shafts having projections, and a cleaning part disposed adjacent to the projections, having one or more rotation holes into which the one or more rotary shafts are inserted, respectively, and configured to flow a cleaning material into the one or more rotation holes.

20 Claims, 7 Drawing Sheets

(56) References Cited

OTHER PUBLICATIONS

English Abstract for Publication No. 2003-297762, Oct. 17, 2003.
English Abstract for Publication No. 1020050013016, Feb. 2, 2005.
English Abstract for Publication No. 2005-171766, Jun. 30, 2005.
English Abstract for Publication No. 1020060009907, Feb. 1, 2006.
English Abstract for Publication No. 1020060084280, Jul. 24, 2006.
English Abstract for Publication No. 1020060075558, Jul. 4, 2006.
English Abstract for Publication No. 2006-525467, May 8, 2007.
English Abstract for Publication No. 10-0773358, Oct. 30, 2007.
Office Action dated Dec. 23, 2010 for U.S. Appl. No. 12/050,063.

* cited by examiner

APPARATUS FOR CLEANING ROTATION BODY AND VACUUM PUMP HAVING THE SAME

CROSS-REFERENCE TO RELATED APPLICATION

This application claims the benefit, under 35 U.S.C. §119, of Korean Patent Application No. 10-2009-0010346, filed on Feb. 9, 2009, the contents of which are herein incorporated by reference in their entirety.

BACKGROUND

1. Technical Field

Exemplary embodiments relate to an apparatus for cleaning a rotation body and a vacuum pump having the same.

2. Description of Related Art

Typically, a process chamber used in a process of manufacturing semiconductor devices or flat panel displays performs a series of processes using various kinds of chemical materials.

Process byproducts and residual gases generated in the process chamber are transmitted to a gas scrubber configured to separate and discharge the process byproducts and the residual gases using a gas discharger such as a vacuum pump.

The vacuum pump includes a stator and a rotor. The stator has an inlet port and an outlet port disposed therein. The rotor is disposed in a pump chamber in the stator. The vacuum pump may be classified as a roots type, a screw type, a claw type, etc.

FIG. 1 shows an exemplary vacuum pump.

Referring to FIG. 1, the vacuum pump includes a rotary shaft 11, a pair of lobes 12, and a first diaphragm 15. A second diaphragm (not shown) may be disposed opposite to the first diaphragm 15. A cylinder wall (not shown) may be disposed surrounding a pump chamber 17 between the first diaphragm 15 and the second diaphragm. The cylinder wall has an inlet port and an outlet port formed therein. The cylinder wall, the first diaphragm 15 and the second diaphragm constitute the stator.

The rotary shaft 11 passes through the first diaphragm 15 and the second diaphragm. The pair of opposite lobes 12 is attached to the rotary shaft 11. The pair of lobes 12 and the rotary shaft 11 constitute the rotor 13. That is, the rotor 13 is disposed in the pump/chamber 17. Two rotors 13, engaged with each other, are disposed in the pump chamber 17.

The rotors 13 are rotated to suction a gas from the inlet port into the pump chamber 17, and the suctioned gas is discharged through the outlet port. That is, the inlet port is connected to the process chamber, and the outlet port is connected to a gas scrubber. Process byproducts are suctioned from the process chamber into the pump chamber 17 through the inlet port provided in the cylinder wall, and then discharged toward the gas scrubber from the pump chamber 17 through the outlet port.

The process byproducts are coagulated while passing through the pump chamber to generate process byproduct lumps 19. Some of the process byproduct lumps 19 stick to the inner surface of the pump chamber 17.

Therefore, when the process byproduct lumps 19 are stuck between the lobes 12 and the first diaphragm 15 or the second diaphragm, rotation of the rotors 13 may be impeded.

In addition, the process byproduct lumps 19 may shorten disassembly and maintenance cycles of the vacuum pump, and cause failures of the apparatus.

Proposed solutions to process byproduct lumps 19 include techniques for heating the stator. Such techniques require that the vacuum pump include materials having high heat transfer efficiency, additional apparatus and increased energy to heat the stator.

SUMMARY

According to an exemplary embodiment, a rotation body cleaning apparatus includes a rotation body having one or more rotary shafts having projections, and a cleaning part disposed adjacent to the projections, having one or more rotation holes into which the one or more rotary shafts are inserted, respectively, and configured to flow a cleaning material provided into the one or more rotation holes.

Here, the cleaning part may include a cleaning body having a chamber formed therein, the one or more rotation holes are formed therein, a main injection hole spaced apart a predetermined distance from the rotation holes and formed at opposite surfaces of the cleaning body to be in fluid communication with the chamber, a main injection flow path connecting the main injection hole to the rotation hole, and a supply flow path connecting the chamber to a supplier configured to supply the cleaning material to the supply flow path.

In addition, the rotation hole may include a first rotation hole and a second rotation hole, which are spaced apart from each other, the main injection hole may be disposed at a central interface of the first rotation hole and the second rotation hole, and the main injection flow path may be bifurcated from the main injection hole to connect the first rotation hole to the second rotation hole.

Further, the cleaning body may have a sub injection flow path in which a sealing member surrounding the rotation hole and adhered to one surface of the projection is disposed, and sub injection holes may be further formed in the sub injection flow path.

A gap may be formed between the sealing member and an inner wall of the sub injection flow path adjacent to a respective one of the rotary shafts under pressure.

Furthermore, the sub injection flow path may further include an auxiliary injection flow path extending a predetermined distance toward the rotation hole.

At least one of the main injection flow path and the auxiliary injection flow path may have a width that increases towards a respective one of the rotary shafts.

The cleaning apparatus may further include a controller controlling the supplier to supply the cleaning material into a chamber of the cleaning part.

According to an exemplary embodiment, the vacuum pump includes a case having rotation guide holes formed at both ends, a rotation body having one or more rotary shafts disposed in the case to be rotatably supported by rotation guide holes formed in both ends of the case, and a plurality of projections provided at the one or more rotary shafts at predetermined intervals, and a cleaning part supported by the case and disposed in a space between the plurality of projections, having one or more rotation holes into which the one or more rotary shafts are inserted, and configured to flow a cleaning material into the one or more rotation holes.

Here, the cleaning part may include a cleaning body having a chamber formed therein and in which the one or more rotation holes are formed therein, a main injection hole spaced apart a predetermined distance from the rotation holes and formed at opposite surfaces of the cleaning body to be in fluid communication with the chamber, a main injection flow path connecting the main injection hole to the rotation hole, a supply flow path connecting the chamber to the exterior, and a supplier configured to supply the cleaning material to the supply flow path.

In addition, the rotation hole may include a first rotation hole and a second rotation hole, which are spaced apart from each other, the main injection hole may be disposed at a central interface of the first rotation hole and the second rotation hole, and the main injection flow path may be bifurcated from the main injection hole to connect the first rotation hole to the second rotation hole.

Further, the cleaning body may have a sub injection flow path in which a sealing member surrounding the rotation hole and adhered to one surface of the projection is disposed, and sub injection holes may be further formed in the sub injection flow path.

A gap may be formed between the sealing member and an inner wall of the sub injection flow path adjacent to a respective one of the rotary shafts under pressure.

Furthermore, the sub injection flow path may further include an auxiliary injection flow path extending a predetermined distance toward the rotation hole.

One of the main injection flow path and the auxiliary injection flow path may have a width that increases towards a respective one of the rotary shafts.

The vacuum pump may include a controller controlling the supplier to supply the cleaning material into a chamber of the cleaning part.

BRIEF DESCRIPTION OF THE DRAWINGS

Exemplary embodiments are described in further detail below with reference to the accompanying drawings. It should be understood that various aspects of the drawings may have been exaggerated for clarity.

DETAILED DESCRIPTION OF EXEMPLARY EMBODIMENTS

Figure 1:
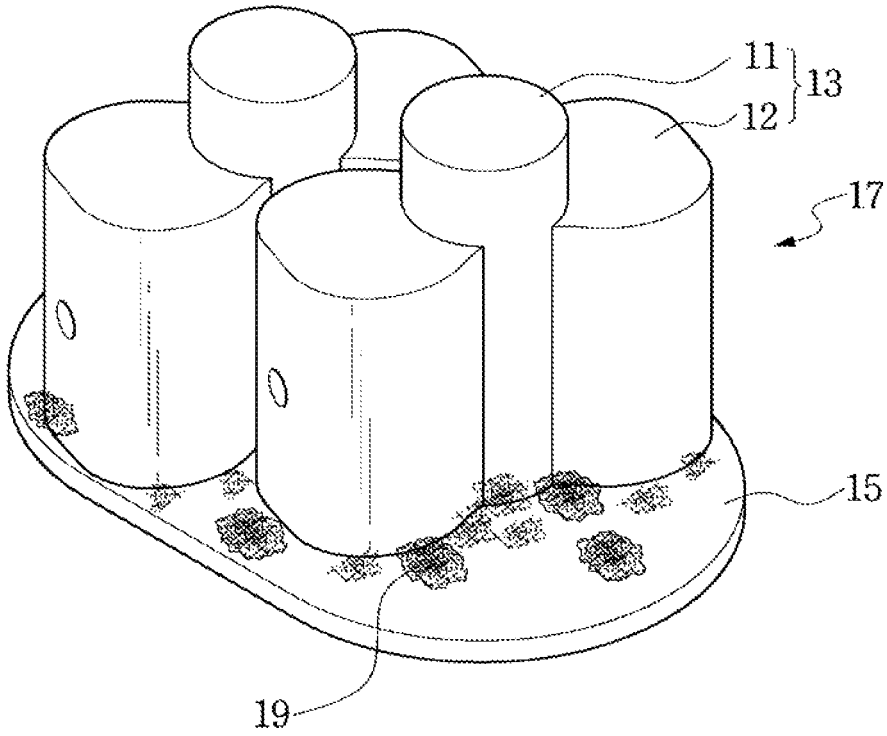
FIG. 1 PRIOR ART
FIG. 1 is a perspective view of a conventional vacuum pump.

Various exemplary embodiments will now be described more fully with reference to the accompanying drawings in which some exemplary embodiments are shown. In the drawings, the thicknesses of layers and regions may be exaggerated for clarity. Detailed illustrative embodiments are disclosed herein. However, specific structural and functional details disclosed herein are merely representative for purposes of describing exemplary embodiments. Inventive concepts, however, may be embodied in many alternate forms and should not be construed as limited to only exemplary embodiments set forth herein.

Figure 2:
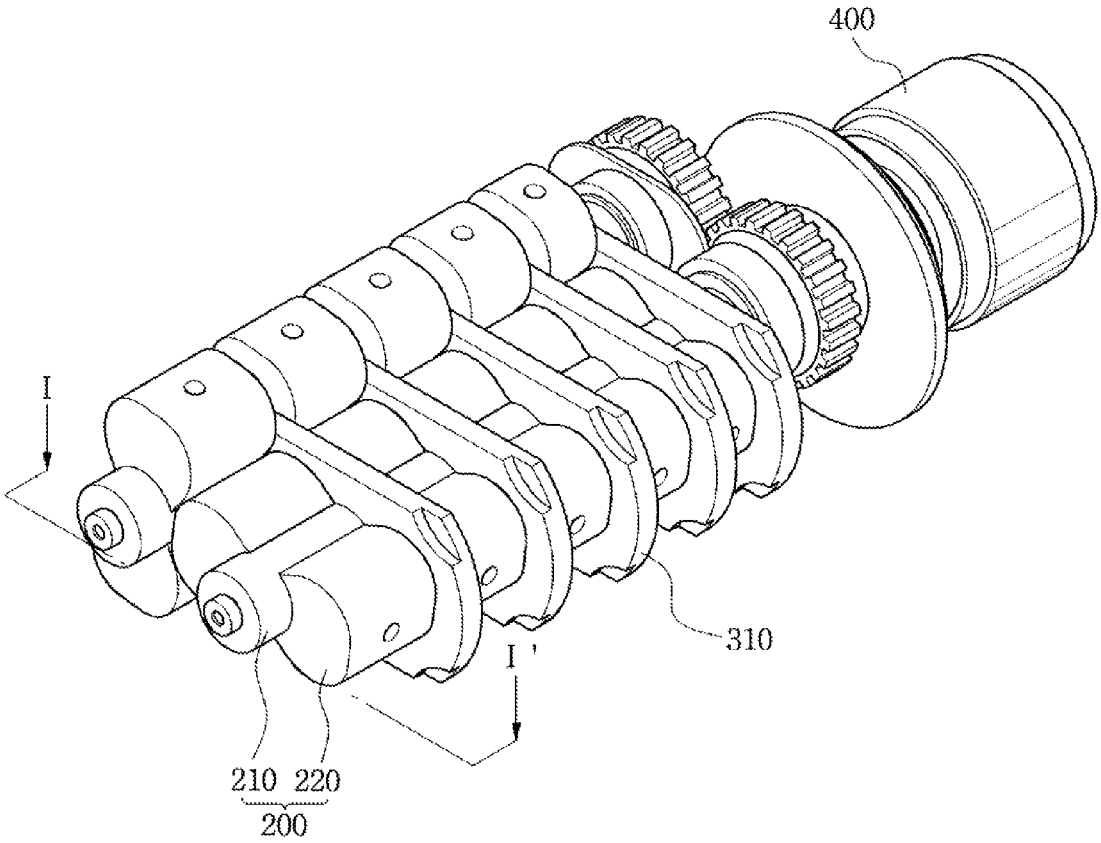
FIG. 2 is a perspective view of a vacuum pump having an apparatus for cleaning a rotation body in accordance with an inventive concept.
Figure 3:
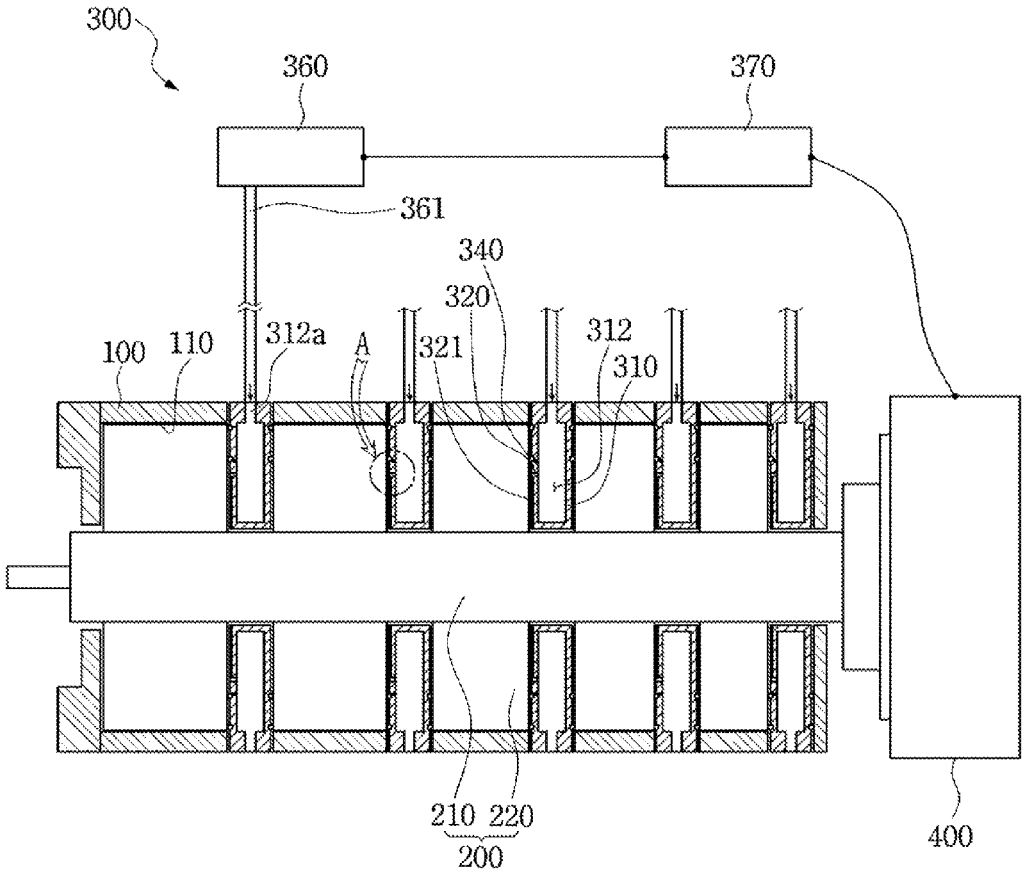
FIG. 3 is a cross-sectional view taken along line I-I' of FIG. 2.
Figure 4:
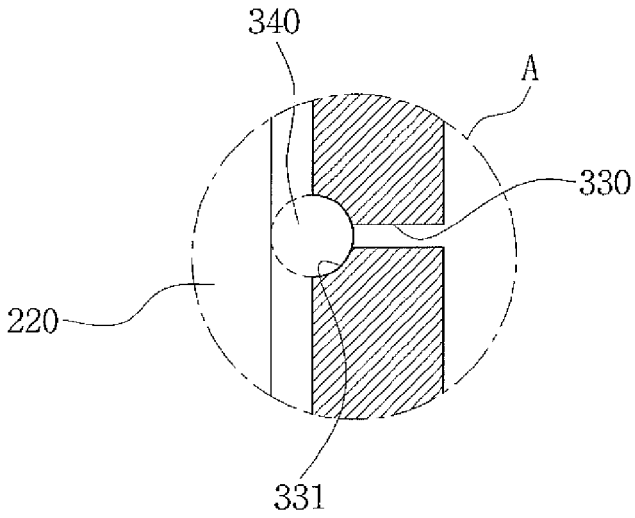
FIG. 4 is an enlarged cross-sectional view of a reference character A of FIG. 3.
Figure 5:
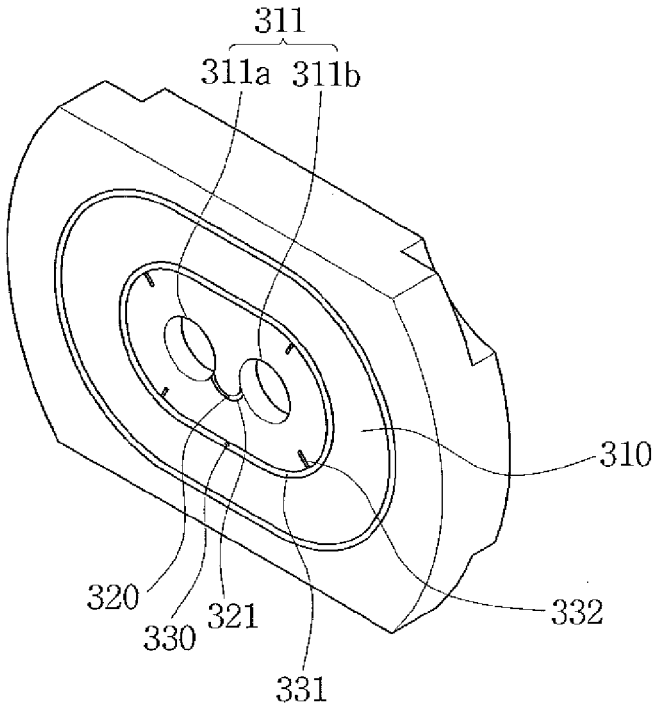
FIG. 5 is a perspective view of an apparatus for cleaning a rotation body in accordance with an inventive concept.
Figure 6:
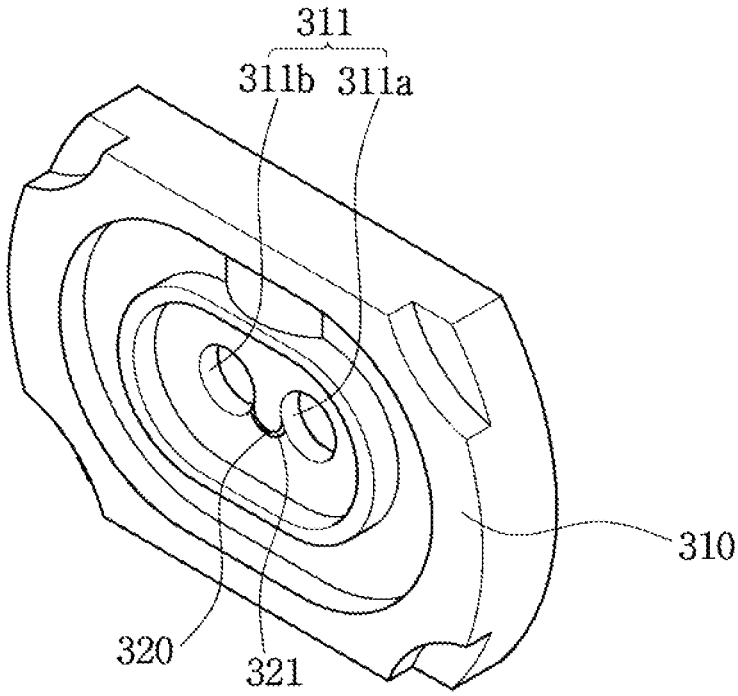
FIG. 6 is a perspective view of another apparatus for cleaning a rotation body in accordance with an inventive concept.
Figure 7:
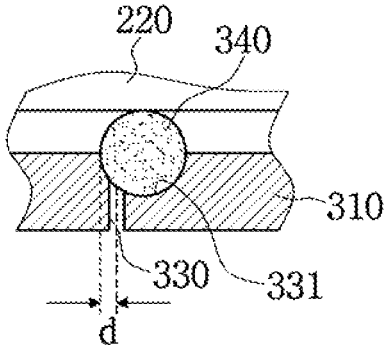
FIG. 7 is a cross-sectional view of a sealing member disposed at an injection flow path of FIG. 5.
Figure 8:
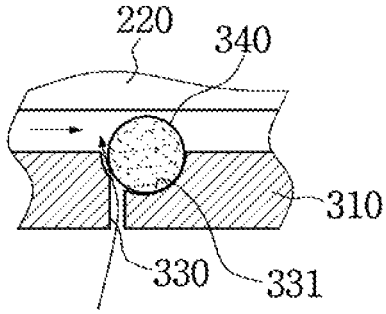
FIG. 8 is a cross-sectional view showing injection of a cleaning material between sealing members from a sub injection flow path of FIG. 7.

FIG. 2 is a perspective view of a vacuum pump having an apparatus for cleaning a rotation body in accordance with an inventive concept; FIG. 3 is a cross-sectional view taken along line I-I' of FIG. 2; FIG. 4 is an enlarged cross-sectional view of a reference character A of FIG. 3; FIG. 5 is a perspective view of an apparatus for cleaning a rotation body in accordance with an inventive concept; FIG. 6 is a perspective view of another apparatus for cleaning a rotation body in accordance with an inventive concept; FIG. 7 is a cross-sectional view of a sealing member disposed at an injection flow path of FIG. 5; FIG. 8 is a cross-sectional view showing injection of a cleaning material between sealing members from a sub injection flow path of FIG. 7.

Referring to FIGS. 2 to 8, an apparatus for cleaning a rotation body in accordance with an inventive concept includes a rotation body 200 having one or more rotary shafts 210 having projections 220, and one or more cleaning parts 300 disposed adjacent to at least one of the projections 220. The cleaning part 300 having one or more rotation holes 311 into which the one or more rotary shafts 210 are inserted, and configured to flow a cleaning material provided from an exterior portion into the rotation hole 311 in a biased direction to clean the rotation body 200. The bias may be created by, for example, an injection pressure of the cleaning material and/or movement of the rotation body 200.

The cleaning part 300 includes a cleaning body 310 having a chamber 312 formed therein. The cleaning body 310 including the one or more rotation holes 311 formed therein, a main injection hole 320 spaced apart a predetermined distance from the rotation holes 311 and formed in the cleaning body 310 to be in fluid communication with the chamber 312, a main injection flow path 321 formed in both surfaces of the cleaning body 310 to connect the main injection hole 320 to the rotation hole 311, a supply flow path 361 configured to connect the chamber 312 to the exterior, and a supplier 360 configured to supply a cleaning material to the supply flow path 361. Here, the cleaning body 310 has a supply hole 312*a* configured to connect the chamber 312 to the supply flow path 361.

Here, the supplier 360 is electrically connected to a controller 370. In addition, the controller 370 is electrically connected to a motor 400 coupled to the rotary shaft 210 to transmit a rotational force to the rotary shaft 210.

Further, the rotation hole 311 includes a first rotation hole 311*a* and a second rotation hole 311*b*, which are spaced apart from each other. Furthermore, the main injection hole 320 is disposed at a central interface of the first rotation hole 311*a* and the second rotation hole 311*b*, and the main injection flow path 321 is bifurcated from the main injection hole 320 to connect the first rotation hole 311*a* to the second rotation hole 311*b*.

Here, the main injection flow path 321 may be bifurcated from the main injection hole 320, e.g., in a 'V' shape. In addition, the main injection flow path 321 may have a curved path to be connected from the main injection hole 320 to the first and second rotation holes 311*a* and 311*b*.

Further, while not shown, the main injection flow path 321 may have a spiral inner surface.

Furthermore, the cleaning body 310 has a sub injection flow path 331 in which a sealing member 340 surrounding the rotation hole 311 and adhered to one surface of the projection 220 is disposed.

In addition, sub injection holes 330 are further formed at a plurality of positions of the sub injection flow path 331. The sub injection holes 330 may be formed as two pairs, and may be disposed on the sub injection flow path 331 opposite each other.

Further, the sub injection flow path 331 may further have an auxiliary injection flow path 332 extending a predetermined distance from the rotation hole 311. Here, the sub injection flow path 331 and the auxiliary injection flow path 332 may have spiral grooves formed at inner surfaces thereof.

Figure 9:
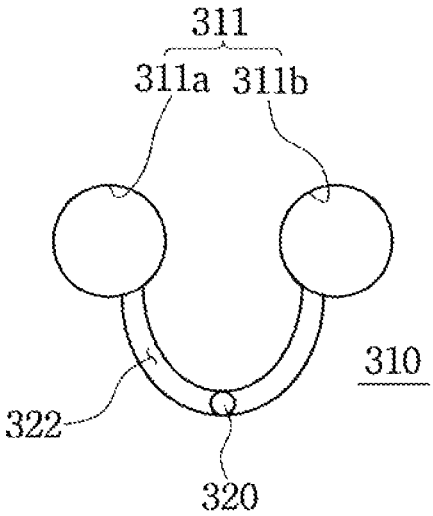
FIG. 9 is a view showing another example of a main injection flow path in accordance with an inventive concept.

Meanwhile, referring to FIG. 9, the main injection flow path 322 may have a width that increases from the main injection hole 320 toward the first and second rotation holes 311*a* and 311*b*.

Figure 10:
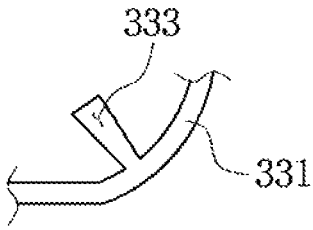
FIG. 10 is a view showing another example of a sub injection flow path in accordance with an inventive concept.

In addition, referring to FIG. 10, the auxiliary injection flow path 333 may also have a width that increases from the sub injection flow path 331 toward the first and second rotation holes 311*a* and 311*b*.

Figure 11:
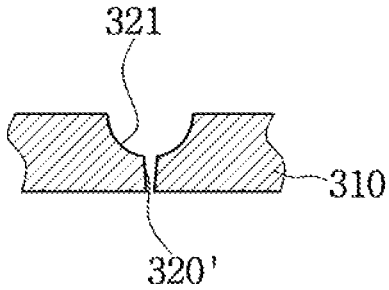
FIG. 11 is a cross-sectional view of another example of a main injection flow path in accordance with an inventive concept.
Figure 12:
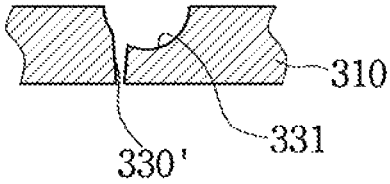
FIG. 12 is a cross-sectional view of another example of a sub injection flow path in accordance with an inventive concept.

Further, referring to FIGS. 11 and 12, a main injection hole 320' and a sub injection hole 330' in accordance with an inventive concept may be formed to be widened from an inner space of the chamber 312 toward an outer surface of the cleaning body 310.

Hereinafter, operations of the apparatus for cleaning a rotation body as constituted above will be described.

Referring to FIGS. 2 and 3, the controller 370 operates the motor 400, and the motor 400 transmits a rotational force to the rotary shaft 210. The rotary shaft 210 is rotated at a certain speed. In addition, the plurality of projections 220, such as lobes, provided at the rotary shaft 210 is also rotated. Here, the cleaning body 310 in accordance with an inventive concept is disposed between the projections 220 to clean outer surfaces of the projections 220 and the rotary shaft 210. Further, the cleaning body 310 in accordance with an inventive concept is disposed between the projections 220 to form a fluid film to substantially prevent process byproducts such as particles from sticking to the outer surfaces of the projections 220.

Operations of the cleaning part 300 will be described below with reference to FIGS. 2 to 8.

The controller 370 operates the supplier 360, and the supplier 360 supplies a cleaning material such as a certain amount of nitrogen gas into the chamber 312 through the supply flow path 361.

The cleaning material supplied into the chamber 312 is injected outside the cleaning body 310 through the main injection hole 320. The injected cleaning material flows into the first and second rotation holes 311*a* and 311*b* along the main injection flow path 321 branched off from the main injection hole 320. Therefore, the cleaning material may be directly supplied to an outer surface of the rotary shaft 210 rotatably inserted into the first and second rotation holes 311*a* and 311*b*.

Here, since the cleaning material flowing along the main injection flow path 321 forms a certain injection pressure, a certain level of pressure or more may be applied to the outer surface of the rotary shaft 210 to remove foreign substances existing on the rotary shaft 210. In addition, the cleaning material supplied as described above may form a certain thickness of fluid film at the outer surfaces of the projections 220 in addition to the outer surface of the rotary shaft 210.

Further, the main injection flow path 321 formed at an opposite side of the cleaning part 300 guides the flow of the cleaning material injected through the main injection hole 320 to the first and second rotation holes 311*a* and 311*b*, and therefore, the outer surface of the rotary shaft 210 and the outer surfaces of the projections 220 may be cleaned by the cleaning material having a certain thickness of fluid film at the outer surfaces.

Therefore, since the main injection hole 320 and the main injection flow path 321 branched off from the main injection hole 320 are formed at both surfaces of the cleaning body 310, the rotary shaft 210 and the projections 220 exposed to both sides of the cleaning body 310 may be cleaned.

As a result, process byproducts (e.g., powder) may not be accumulated on the outer surfaces of the rotary shaft 210 and the projections, on which the fluid film is formed, the process byproducts may not be interposed therebetween, and contact with corrosive gases may be minimized.

The sub injection flow path 331, which may be formed at both sides of the cleaning body 310, is formed as a groove having a certain depth to surround the rotation holes 311, and a sealing member 340 such as an O-ring having a certain diameter may be inserted into the sub injection flow path 331.

The sealing member 340 is adhered between the outer surface of the cleaning body and the surfaces of the projections to substantially prevent introduction of foreign substances from the exterior along the rotary shaft 210.

When the rotary shaft 210 is rotated, a certain level of pressure or more is formed in a space (hereinafter, referred to as a cleaning space) between the outer surfaces of the rotary shaft 210, the sealing member 340 and the projections 220 to push the sealing member 340 in a direction away from the rotary shaft 210.

Here, the sub injection holes 330 formed at a plurality of positions of the sub injection flow path 331 may be exposed to the cleaning space. Therefore, the cleaning material supplied into the chamber 312 may be injected into the sub injection flow path 331 through the sub injection holes 330.

The cleaning material injected as described above may move along the sub injection flow path 331 and flow along the auxiliary injection flow paths 332 formed at a plurality of positions on the sub injection flow path 331 to be supplied into the cleaning space.

The cleaning material supplied into the cleaning space may be spread in the cleaning space, a certain thickness of fluid film may be formed at the outer surfaces of the projections and the outer surface of the rotary shaft 210 exposed to the cleaning space, and the foreign substances formed at the outer surfaces may be readily removed.

While it has been exemplarily described that nitrogen gas is injected into the chamber 312 through the supplier 360, fluid other than the gas may be used as the cleaning material.

In addition, the controller 370 controls an operation of the supplier 360. Here, a flow rate of the cleaning material supplied into the chamber 312 through the supplier 360 may be set by the controller 370 to be proportional to a rotational speed of the rotary shaft 210. In this case, the motor 400 may transmit the rotational speed of the rotary shaft 210 to the controller 370 through a device such as an encoder.

FIG. 9 is a view showing another example of a main injection flow path in accordance with the inventive concept. Referring to FIG. 9, the main injection flow path 322 may have a width that increases from the main injection hole 320 toward the first and second rotation holes 311*a* and 311*b*.

FIG. 10 is a view showing another example of a sub injection flow path in accordance with the inventive concept. Referring to FIG. 10, the auxiliary injection flow path 333 may also have a width that increases from the sub injection flow path 331 toward the first and second rotation holes 311*a* and 311*b*.

FIG. 11 is a cross-sectional view of another example of a main injection flow path in accordance with the inventive concept; and FIG. 12 is a cross-sectional view of another of a sub injection flow path in accordance with the inventive concept. Referring to FIGS. 11 and 12, a main injection hole 320' and a sub injection hole 330' may be may have a width that increases from the inner space of the chamber toward the outer surface of the cleaning body 310.

Hereinafter, constitution of a vacuum pump in accordance with an exemplary embodiment of an inventive concept will be described.

Referring to FIGS. 2 and 3, the vacuum pump in accordance with an inventive concept includes a case 100 having rotation guide holes 110 formed at both ends thereof, a rotation body 200 having one or more rotary shafts 210 disposed in the case 100 and rotatably supported by the rotation guide holes 110 at both ends thereof and a plurality of projections 220 disposed at predetermined intervals on the one or more rotary shafts 210, and a cleaning body 310 supported by the case 100 and disposed in a space between the projections 220, having one or more rotation holes 311 into which the one or more rotary shafts 210 are inserted, and configured to flow a cleaning material supplied from the exterior into the rotation holes 311 in a biased direction to clean the rotary body 200. The bias may be created by, for example, an injection pressure of the cleaning material and/or movement of the rotation body 200.

Referring to FIGS. 3 to 8, the cleaning part 300 includes a cleaning body 310 having a chamber 312 formed therein and in which the one or more rotation holes 311 are formed, a main injection hole 320 spaced apart a predetermined distance from the rotation hole 311 and formed at the cleaning body 310 to be in fluid communication with the chamber 312, a main injection flow path 321 formed at both surfaces of the cleaning body 310 and configured to connect the main injection hole 320 to the rotation hole 311, a supply flow path 361 configured to connect the chamber 312 to the exterior, and a supplier 360 configured to supply a cleaning material into the supply flow path 361.

Here, the supplier 360 is electrically connected to the controller 370. In addition, the controller 370 is electrically connected to the motor 400 connected to the rotary shaft 210 to transmit a rotational force to the rotary shaft 210.

In addition, the rotation hole 311 is constituted by a first rotation hole 311*a* and a second rotation hole 311*b*, which are spaced apart from each other. Further, the main injection hole 320 is disposed at a central interface between the first rotation hole 311*a* and the second rotation hole 311*b*, and the main injection flow path 321 is branched off from the main injection hole 320 to connect the first rotation hole 311*a* to the second rotation hole 311*b*.

Here, the main injection flow path 321 may be bifurcated from the main injection hole 320, e.g., in a 'V' shape. In addition, the main injection flow path 321 may form a curved path connected from the main injection hole 320 to the first and second rotation holes 311*a* and 311*b*.

Further, the inner surface of the main injection flow path 321 may have a spiral shape.

Furthermore, the cleaning body 310 has a sub injection flow path 331 configured to surround the rotation hole 311 and in which a sealing member 340 adhered to one surface of the projection 220 is disposed.

In addition, sub injection holes 330 are further formed at a plurality of positions of the sub injection flow path 331. The sub injection holes 330 may be provided in two pairs and disposed on the sub injection flow path 331 to oppose each other.

Further, the sub injection flow path 331 may further have an auxiliary injection flow path 332 extending toward the rotation hole 311 by a predetermined length. Here, the inner surface of the auxiliary injection flow path 332 may have a spiral groove.

Hereinafter, operation of the vacuum pump constituted as above will be described.

Referring to FIGS. 2 and 3, a controller 370 operates a motor 400. The motor 400 transmits a rotational force to the rotary shaft 210. The rotary shaft 210 is rotated at a certain speed. At this time, the motor 400 may transmit a rotational speed of the rotary shaft 210 to the controller 370 using a device such as an encoder. In addition, the plurality of projections 220 such as lobes provided at the rotary shaft 210 is also rotated therewith.

Here, the cleaning body 310 in accordance with an inventive concept is disposed between the projections 220 to clean the outer surface of the projections 220 and the outer surface of the rotary shaft 210, and disposed between the projections 220 to form a fluid film to substantially prevent process byproducts such as particles from sticking to the outer surfaces of the projections 220.

Operation of the cleaning part 300 will be described below with reference to FIGS. 2 to 8.

The controller 370 operates the supplier 360 to supply a cleaning material into the chamber 310 according to a flow rate predetermined in proportion to the rotational speed.

Therefore, the supplier 360 supplies a cleaning material such as a certain amount of nitrogen gas into the chamber 312 through the supply flow path 361 to correspond to a flow rate predetermined by the controller 370. Here, the cleaning material may use a fluid other than the gas.

The cleaning material supplied into the chamber 312 is injected to the exterior of the cleaning body 310 through the main injection hole 320. The injected cleaning material moves into the first rotation hole 311*a* and the second rotation hole 311*b* along the main injection flow path 321 branched off from the main injection hole 320. Therefore, the cleaning material may be directly supplied to the exterior of the rotary shaft 210 rotatably inserted in the rotation hole 311.

Since the cleaning material moving along the main injection flow path 321 forms a certain level of injection pressure, a certain level of pressure or more may be applied to the exterior of the rotary shaft 210 to remove foreign substances on the rotary shaft 210. In addition, the cleaning material supplied as above may form a certain thickness of fluid film at the outer surface of the rotary shaft 210 and the outer surfaces of the projections 220.

In addition, the main injection flow path 321 formed at the other side of the cleaning part 300 may also guide the cleaning material injected through the main injection hole 320 to be moved into the first and second rotation holes 311*a* and 311*b*, and thus, the outer surface of the rotary shaft 210 and the outer surfaces of the projections 200 may be cleaned and a certain thickness of fluid film may be formed on the outer surfaces.

Therefore, since the main injection hole 320 and the main injection flow path 321 branched off therefrom are formed at both sides of the cleaning body 310, the rotary shaft 210 and the projections exposed to both sides of the cleaning body 310 may be readily cleaned.

As a result, the process byproducts (e.g., powder) may not be accumulated on the outer surfaces of the rotary shaft 210 and the projections 220, on which the fluid film is formed, the process byproducts may not be interposed therebetween, and contact with corrosive gases may be minimized.

The sub injection flow path 331 formed at both sides of the cleaning body 310 may have a certain depth of groove to surround the rotation holes 311, and the sealing member 340 such as an O-ring having a certain diameter may be inserted into the sub injection flow path 331. Therefore, the sealing member 340 may be adhered between the outer surface of the cleaning body 310 and the outer surfaces of the projections 220 to substantially prevent introduction of foreign substances from the exterior along the rotary shaft 210.

When the rotary body 210 is rotated, a certain level of pressure or more is formed in a cleaning space between the outer surfaces of the rotary shaft 210, the sealing member 340 and the projections 220.

As shown in FIG. 8, the pressure formed in the cleaning space may push the sealing member 340 away from the rotary shaft 210. Therefore, a gap d (see FIG. 7) may be opening between the sealing member 340 and an inner wall of the sub injection to flow path 331 adjacent to the rotary shaft 210 to be about 0.2 mm in width.

Here, since the sub injection holes 330 formed at a plurality of positions of the sub injection flow path 331 may be disposed in the gap d, the sub injection holes 330 may be exposed to the cleaning space. Therefore, the cleaning material supplied into the chamber 312 may be injected into the sub injection flow path 331 through the sub injection holes 330 exposed to the gap d.

The cleaning material injected as above may move along the sub injection flow path 331 and flow along the auxiliary injection flow paths 332 formed at a plurality of positions on the sub injection flow path 331 to be supplied into the cleaning space.

The cleaning material supplied into the cleaning space may be spread in the cleaning space, a certain thickness of fluid film may be formed at the outer surfaces of the projections 220 and the outer surface of the rotary shaft 210 exposed to the cleaning space, and foreign substances formed on the outer surfaces may be readily removed.

Since the main injection flow path 321, the sub injection flow path 331 and the auxiliary injection flow path 332 may have spiral inner surfaces, a flow speed of the cleaning material moved therethrough may be increased to a certain level or more.

In addition, as shown in FIGS. 9 and 10, since the main injection flow path 322 and the auxiliary injection flow path 333 may have a width that increases toward the rotary shaft 210, a certain amount of cleaning material or more may be readily supplied around the rotary shaft 210 and into the cleaning space.

Further, as shown in FIGS. 11 and 12, since the main injection hole 320' and the sub injection hole 330' have diameters that increase from the chamber toward the outer surface of the cleaning body 310, a certain flow rate of cleaning material or more supplied into the chamber 312 may be injected to the exterior of the cleaning body.

While not shown, the diameters of the main injection hole and the sub injection hole may be reduced from the chamber 312 toward the exterior of the cleaning body 310. In this case, the cleaning material injected from the chamber 312 along the outer space of the cleaning body may be injected at a certain level of injection speed or more.

As can be seen from the foregoing, when a semiconductor manufacturing process is performed, a cleaning material can be directly supplied to an outer surface of a rotation body to substantially prevent process byproducts from sticking to a rotation body.

In addition, the cleaning material is supplied toward the rotary shaft at a certain position adjacent to the rotary shaft to clean the rotary shaft and outer surfaces of projections provided at the rotary shaft.

The foregoing is illustrative of exemplary embodiments and is not to be construed as limiting thereof. Although a few exemplary embodiments have been described, those skilled in the art will readily appreciate that many modifications are possible in exemplary embodiments without materially departing from the novel teachings and advantages. Accordingly, all such modifications are intended to be included within the scope of inventive concepts as defined in the claims. In the claims, means-plus-function clauses are intended to cover the structures described herein as performing the recited function, and not only structural equivalents but also equivalent structures. Therefore, it is to be understood that the foregoing is illustrative of various exemplary embodiments and is not to be construed as limited to the specific embodiments disclosed, and that modifications to the disclosed embodiments, as well as other embodiments, are intended to be included within the scope of the appended claims.

What is claimed is:

1. An apparatus comprising:

a rotation body having a plurality of rotary shafts having projections; and a cleaning part disposed adjacent to the projections, having a first rotation hole and a second rotation hole spaced apart from each other into which the rotary shafts are inserted, respectively, and configured to flow a cleaning material provided into the first and second rotation holes, wherein the cleaning part comprises a cleaning body having a chamber formed therein, the first and second rotation holes formed therein, a main injection hole spaced apart a predetermined distance from the first and second rotation holes at an interface between the first and second rotation holes and formed at opposite surfaces of the cleaning body to be in fluid communication with the chamber, a main injection flow path which is bifurcated from the main injection hole to connect the main injection hole to the first and second rotation holes and to connect the first rotation hole to the second rotation hole.

2. The apparatus according to claim 1, further comprising: a supply flow path connecting the chamber to a supplier configured to supply the cleaning material to the supply flow path.

3. The apparatus according to claim 2, wherein the main injection hole is disposed at a central interface of the first rotation hole and the second rotation hole.

4. The apparatus according to claim 2, wherein the cleaning body has a sub injection flow path in which a sealing member surrounding the first and second rotation holes and adhered to one surface of the projection is disposed, and sub injection holes are further formed in the sub injection flow path.

5. The apparatus according to claim 4, wherein a gap is formed between the sealing member and an inner wall of the sub injection flow path adjacent to a respective one of the rotary shafts under pressure.

6. The apparatus according to claim 4, wherein the sub injection flow path further includes an auxiliary injection flow path extending a predetermined distance toward the first and second rotation holes.

7. The apparatus according to claim 6, wherein at least one of the main injection flow path and the auxiliary injection flow path has a width that increases towards a respective one of the rotary shafts.

8. The apparatus according to claim 1, further comprising a controller controlling a supplier to supply the cleaning material into a chamber of the cleaning part.

9. A vacuum pump comprising:

a case having rotation guide holes formed at both ends;

a rotation body having a plurality of rotary shafts disposed in the case to be rotatably supported by rotation guide holes formed in both ends of the case, and a plurality of projections provided at the rotary shafts at predetermined intervals; and a cleaning part supported by the case and disposed in a space between the plurality of projections, having a first rotation hole and a second rotation role into which the rotary shafts are inserted, and configured to flow a cleaning material into the first and second rotation holes, wherein the cleaning part comprises a cleaning body having a chamber formed therein, the first and second rotation holes formed therein, a main injection hole spaced apart a predetermined distance from the first and second rotation holes at an interface between the first and second rotation holes and formed at opposite surfaces of the cleaning body to be in fluid communication with the chamber, a main injection flow path which is bifurcated from the main injection hole to connect the main injection hole to the first and second rotation holes and to connect the first rotation hole to the second rotation hole.

10. The vacuum pump according to claim 9, further comprising: a supply flow path connecting the chamber to the exterior, and a supplier configured to supply the cleaning material to the supply flow path.

11. The vacuum pump according to claim 10, wherein the cleaning body has a sub injection flow path in which a sealing member surrounding the first and second rotation holes and adhered to one surface of the projection is disposed, and sub injection holes are further formed in the sub injection flow path.

12. The vacuum pump according to claim 11, wherein a gap is formed between the sealing member and an inner wall of the sub injection flow path adjacent to a respective one of the rotary shafts under pressure.

13. The apparatus according to claim 12, wherein at least one of the main injection flow path and the auxiliary injection flow path has a width that increases towards a respective one of the rotary shafts.

14. The vacuum pump according to claim 11, wherein the sub injection flow path further includes an auxiliary injection flow path extending a predetermined distance toward the first and second rotation holes.

15. The vacuum pump according to claim 9, wherein the main injection hole is disposed at a central interface of the first rotation hole and the second rotation hole.

16. The apparatus according to claim 9, further comprising a controller controlling a supplier to supply the cleaning material into a chamber of the cleaning part.

17. A vacuum pump comprising:

a rotary shaft including a plurality of projections; a cleaning body disposed between the projections, the cleaning body including a chamber, a rotation hole into which the rotation shaft is inserted, a sub injection flow path surrounding the rotation hole and a sub injection hole in the sub injection flow path; and a sealing member disposed between the projection and the cleaning body, wherein the sealing member is disposed in the sub injection flow path, and the sub injection hole is disposed near to the rotation hole.

18. The vacuum pump according to claim 17, wherein a width of the sub injection hole is increased toward the sealing member.

19. The vacuum pump according to claim 17, wherein the sub injection flow path includes an auxiliary injection flow path extending toward the rotation hole.

20. The vacuum pump according to claim 17, wherein the cleaning body further includes a main injection hole spaced apart from the rotation hole, and a main injection flow path connecting the main injection hole to the rotation hole, the main injection hole being disposed between the rotation hole and the sub injection flow path.

* * * * *